US008492636B2

(12) United States Patent
Hara

(10) Patent No.: US 8,492,636 B2
(45) Date of Patent: Jul. 23, 2013

(54) CHORD DETECTION APPARATUS, CHORD DETECTION METHOD, AND PROGRAM THEREFOR

(75) Inventor: Akihide Hara, Hamamatsu (JP)

(73) Assignee: Yamaha Corporation (JP)

( * ) Notice: Subject to any disclaimer, the term of this patent is extended or adjusted under 35 U.S.C. 154(b) by 10 days.

(21) Appl. No.: 13/218,521

(22) Filed: Aug. 26, 2011

(65) Prior Publication Data

US 2012/0060667 A1 Mar. 15, 2012

(30) Foreign Application Priority Data

Sep. 15, 2010 (JP) ..... 2010-206563

(51) Int. Cl.
*G10H 1/38* (2006.01)

(52) U.S. Cl.
USPC ..... 84/613; 84/609; 84/637; 84/649; 84/650; 84/669

(58) Field of Classification Search
None
See application file for complete search history.

(56) References Cited

U.S. PATENT DOCUMENTS 5,179,241 A * 1/1993 Okuda et al. ..... 84/613
5,296,644 A * 3/1994 Aoki ..... 84/637
5,760,325 A * 6/1998 Aoki ..... 84/613
6,031,171 A * 2/2000 Tohgi et al. ..... 84/470 R
7,485,797 B2 * 2/2009 Sumita ..... 84/613
2004/0144238 A1 * 7/2004 Gayama ..... 84/613
2004/0255759 A1 * 12/2004 Gayama ..... 84/613
2005/0109194 A1 * 5/2005 Gayama ..... 84/613
2006/0070510 A1 * 4/2006 Gayama ..... 84/613
2006/0075881 A1 * 4/2006 Streitenberger et al. ..... 84/609
2008/0034947 A1 * 2/2008 Sumita ..... 84/613
2010/0126332 A1 * 5/2010 Kobayashi ..... 84/613
2010/0175540 A1 * 7/2010 Ikeya et al. ..... 84/613
2011/0203444 A1 * 8/2011 Yamauchi et al. ..... 84/622
2012/0060667 A1 * 3/2012 Hara ..... 84/613

FOREIGN PATENT DOCUMENTS

JP 2001-142462 A 5/2001

* cited by examiner

*Primary Examiner* — Marlon Fletcher
(74) *Attorney, Agent, or Firm* — Rossi, Kimms & McDowell, LLP

(57) ABSTRACT

A chord detection apparatus capable of detecting a wide variety of chords musically related to realtime performance. Degree name candidates each having a function that can come next are extracted in a first extraction process, degree name candidates corresponding to an interrupted cadence are extracted in a second extraction process, and degree name candidates corresponding to a non-functional chord progression technique are extracted in a third extraction process. The degree name candidates extracted in these extraction processes are developed into chord names according to a current tonality, and one of chords represented by the chord names is selected according to performance data and output to an automatic accompaniment apparatus for sound production.

20 Claims, 15 Drawing Sheets

*FIG.3A*

MAJOR TONALITY

| FUNCTION | DIATONIC SCALE CHORD | OTHER THAN DIATONIC SCALE CHORD | FUNCTION THAT CAN COME NEXT |
|---|---|---|---|
| T: TONIC | IMaj7,I6,Iadd9,IMaj7sus4, I6sus4,Iadd9sus4,IIIm7, VIm7,I,Isus4 | # Vm7(♭5),♭IIIMaj7,♭IIIadd9, ♭IIIMaj7,♭III6,♭IIIadd9, ♭IIIMaj7sus4,♭III6sus4, ♭IIIadd9sus4,♭VIMaj7,♭III,♭IIIsus4 | T,S,D,SM |
| S: SUBDOMINANT | IIm7,IVMaj7,IV6,IVadd9,IV | IV7,VII7,♭VIIMaj7,VII7sus4 | T,S,D,SM |
| D: DOMINANT | V7,V7sus4,VIIm7(♭5) | ♭II7 | T,D,(SM) |
| SM:SUBDOMINANT MINOR | | IVm7,IVm6,IVmMaj7, ♭IIMaj7,IIm7(♭5),♭VII7,♭VII6 ♭VIMaj7 | T,D,SM |

FIG.3B

MINOR TONALITY

| FUNCTION | DIATONIC SCALE CHORD | OTHER THAN DIATONIC SCALE CHORD | FUNCTION THAT CAN COME NEXT |
|---|---|---|---|
| T: TONIC | Im7,Im6,Imadd9,ImMaj7, ♭IIIMaj7,♭III6,♭IIIadd9, ♭IIIMaj7sus4,♭III6sus4, ♭IIIadd9sus4,♭VIMaj7,♭VI6, ♭VIadd9,VIm7(♭5),♭III, ♭IIIsus4,♭VI | IMaj7,I6,IMaj7sus4,I6sus4, Iadd9sus4,♭VI7,I,Isus4 | T,S,D |
| S: SUBDOMINANT | IIm7(♭5),IIm7,IVm7,IVm6, IV7 | ♭IIMaj7 | T,S,D |
| D: DOMINANT | Vm7,V7,V7sus4,♭VII7, ♭VII7sus4,♭VII6,♭VIIadd9, VIIdim,VIIm7(♭5) | ♭II7 | T,D |
| SM: SUBDOMINANT MINOR | NON | NON | |

FIG.4A

MAJOR TONALITY

| TECHNIQUE | LAST | CUR-RENT | NEXT |
|---|---|---|---|
| PASSING DIMINISH | IMaj7,I6,Iadd9,IMaj7sus4, I6sus4,Iadd9sus4,IIIm7, VIm7,I,Isus4 | #Idim | IIm7,IVMaj7,IV6,IVadd9,IV |
| | IIm7,IVMaj7,IV6,IVadd9,IV | #IIdim | IMaj7,I6,Iadd9,IMaj7sus4, I6sus4,Iadd9sus4,IIIm7, VIm7,I,Isus4 |
| | IIm7,IVMaj7,IV6,IVadd9,IV | #IVdim | V7,V7sus4,VIIm7(♭5) |
| | V7,V7sus4,VIIm7(♭5) | #Vdim | IMaj7,I6,Iadd9,IMaj7sus4, I6sus4,Iadd9sus4,IIIm7, VIm7,I,Isus4 |
| | IMaj7,I6,Iadd9,IMaj7sus4, I6sus4,Iadd9sus4,IIIm7, VIm7,I,Isus4 | ♭IIIdim | IIm7,IVMaj7,IV6,IVadd9,IV |
| PARALLEL MOTION | IIm7 | #IIm7 | IIIm7 |
| | IIIm7 | ♭IIIdim | IIm7 |
| CLICHE | IMaj7,Iadd9,IMaj7sus4, Iadd9sus4,I,Isus4 | Iaug | I6,I6sus4,IIIm7,VIm7, #IVm7(♭5),IVMaj7,IV6, IVadd9,IIm7,IV7,VII7, ♭VIIMaj7,VII7sus4,I,Isus4,IV |
| | I6,I6sus4,I,Isus4 | Iaug | IMaj7,Iadd9,IMaj7sus4, Iadd9sus4,IIIm7,VIm7, #IVm7(♭5),IVMaj7,IV6, IVadd9,IIm7,IV7,VII7, ♭VIIMaj7,VII7sus4,I,Isus4,IV |

FIG.4B

MINOR TONALITY

| TECHNIQUE | LAST | CUR-RENT | NEXT |
|---|---|---|---|
| PASSING DIMINISH | Im7,Im6,Imadd9,ImMaj7, ♭IIIMaj7,♭III6,♭IIIadd9, ♭IIIMaj7sus4,♭III6sus4, ♭IIIadd9sus4,♭VIMaj7,♭VI6, ♭VIadd9,VIm7(♭5),♭III, ♭IIIsus4,♭VI | IIIdim | IIm7(♭5),IIm7,IVm7,IVm6, IV7 |
| | IIm7(♭5),IIm7,IVm7,IVm6, IV7 | #IVdim | Vm7,V7,V7sus4,♭VII7, ♭VII7sus4,♭VII6,♭VIIadd9 |
| | Im7,Im6,Imadd9,ImMaj7, ♭IIIMaj7,♭III6,♭IIIadd9, ♭IIIMaj7sus4,♭III6sus4, ♭IIIadd9sus4,♭VIMaj7,♭VI6, ♭VIadd9,VIm7(♭5),♭III, ♭IIIsus4,♭VI | VIdim | Vm7,V7,V7sus4,♭VII7, ♭VII7sus4,♭VII6,♭VIIadd9 |
| | Vm7,V7,V7sus4,♭VII7, ♭VII7sus4,♭VII6,♭VIIadd9 | VIIdim | Im7,Im6,Imadd9,ImMaj7, ♭IIIMaj7,♭III6,♭IIIadd9, ♭IIIMaj7sus4,♭III6sus4, ♭IIIadd9sus4,♭VIMaj7,♭VI6, ♭VIadd9,VIm7(♭5),♭III, ♭IIIsus4,♭VI |
| | Vm7,V7,V7sus4,♭VII7, ♭VII7sus4,♭VII6,♭VIIadd9, VIIdim,VIIm7(♭5) | ♭Vdim | IIm7(♭5),IIm7,IVm7,IVm6, IV7 |
| PARALLEL MOTION | IVm7 | #IVm7 | Vm7 |
| | Vm7 | ♭Vm7 | IVm7 |

CHORD DETECTION APPARATUS, CHORD DETECTION METHOD, AND PROGRAM THEREFOR

BACKGROUND OF THE INVENTION

1. Field of the Invention

The present invention relates to a chord detection apparatus, a chord detection method, and a program for detecting from performance data a chord (harmonic tones) musically related to the performance data, which is input according to a performance operation.

2. Description of the Related Art

Conventionally, an electronic musical instrument for detecting, from performance data, a chord musically related to performance data is known. The detected chord is added to a melody, for example.

As such an electronic musical instrument, there is known an instrument that inputs and stores performance data representing a sequence of notes, divides the stored performance data into predetermined sections, and extracts a chord progression conforming to performance data of one of the divided sections of the performance data from a chord progression database stored with a large number of chord progressions (see, for example, Japanese Laid-open Patent Publication No. 2001-142462).

Since the above-described electronic musical instrument extracts a chord progression conforming to performance data input beforehand, a chord progression musically well related to a stream of notes in the performance data can be extracted by taking account of not only performance tones preceding a current performance tone, but also performance tones subsequent to the current performance tone. However, if an attempt is made to extract a chord progression musically well related to performance data which is being input during real time performance, a chord progression extraction in which performance tones subsequent to a current performance tone are taken into account cannot be made since a performance tone that will be next input is unknown. As a result, a chord progression musically well related to realtime performance data cannot be extracted in some cases.

To eliminate the above problem, there is a technique to examine whether a chord progression formed by continuously extracted chords is stored in a chord progression database, predict a chord that follows the chord progression (if any) stored in the database, and determine whether the predicted chord is consonant with the next input performance data. With this technique, if the predicted chord is not consonant with the next input performance data, a chord other than the predicted chord is extracted, resulting in a fear that the extracted chord is not musically related to the performance data. Conversely, if the predicted chord is consonant with the next input performance data, the predicted chord is extracted and thus a chord progression musically related to the performance data can be obtained. However, there is a tendency that the same chord progression frequently appears, causing the user to get tired of chord progressions.

SUMMARY OF THE INVENTION

The present invention provides a chord detection apparatus, a chord detection method, and a program, which are capable of detecting a wide variety of chords musically related to realtime performance.

According to a first aspect of the present invention, there is provided a chord detection apparatus, which comprises a performance data acquisition unit configured to acquire performance data, a tonality information acquisition unit configured to acquire tonality information in the performance data, an instruction unit configured to detect a chord detection timing and give an instruction for chord detection, a reference unit configured to refer to a reference chord, an extraction unit configured to extract, according to the tonality information acquired by the tonality information acquisition unit, chord candidates that can follow the reference chord having been referred to by the reference unit, and a selection unit configured to select a chord from the chord candidates extracted by the extraction unit according to the performance data acquired by the performance data acquisition unit when the instruction for chord detection is given by the instruction unit.

With this invention, chord candidates that can follow the reference chord having been referred to by the reference unit are extracted based on the tonality information acquired by the tonality information acquisition unit, and a chord is selected from the extracted chord candidates based on performance data acquired by the performance data acquisition unit when the instruction for chord detection is given by the instruction unit. Thus, a variety of chords musically related to realtime performance can be detected.

In this invention, the chord detection apparatus can further include a storage unit configured to store the chord selected by the selection unit so as to be capable of being referred to by the reference unit.

The extraction unit can determine a function of the reference chord based on the acquired tonality information, can determine functions that can follow the determined function of the reference chord, and can extract chords each having any of the determined functions, as the chord candidates.

In that case, a function of the reference chord is determined based on the acquired tonality information, functions that can follow the determined function of the reference chord are determined, and chords each having any of the determined function are extracted as the chord candidates. Thus, a variety of chords musically related to realtime performance can be detected.

The chord detection apparatus can further include a detection unit configured to detect a break in performance music, and the extraction unit can extract even a chord that can produce an interrupted cadence, as a chord candidate, at a time of chord candidate extraction after the break being detected by the detection unit.

In that case, even a chord that can produce an interrupted cadence, i.e., a chord normally prohibited from being included in chord progression, is extracted as a chord candidate when the chord candidate extraction is made after a break is detected by the detection unit. Thus, a fresh chord progression unexpected by the user or listeners is sometimes provided.

The extraction unit can determine a non-functional chord progression technique that can follow the reference chord, and can extract even a chord corresponding to the determined non-functional chord progression technique, as a chord candidate.

In that case, a non-functional chord progression technique that can follow the reference chord is determined, and even a chord corresponding to the determined non-functional chord progression technique is extracted as a chord candidate. Thus, a much variety of chords musically related to realtime performance can be detected.

According to a second aspect of this invention, there is provided a chord detection method corresponding to the chord detection apparatus described in the first aspect of this invention.

According to a third aspect of this invention, there is provided a program for executing the chord detection method described in the second aspect of this invention.

Further features of the present invention will become apparent from the following description of an exemplary embodiment with reference to the attached drawings.

BRIEF DESCRIPTION OF THE DRAWINGS

FIG. 3A is a view showing an example of a correspondence table between chord functions and degree names for major tonality;

FIG. 3B is a view showing an example of a correspondence table between chord functions and degree names for minor tonality;

FIG. 4A is a view showing an example listing of degree names appearing in non-functional chord progressions for major tonality;

FIG. 4B is a view showing an example listing of degree names appearing in non-functional chord progressions for minor tonality;

DESCRIPTION OF THE EMBODIMENTS

The present invention will now be described in detail below with reference to the drawings showing a preferred embodiment thereof.

Figure 1:
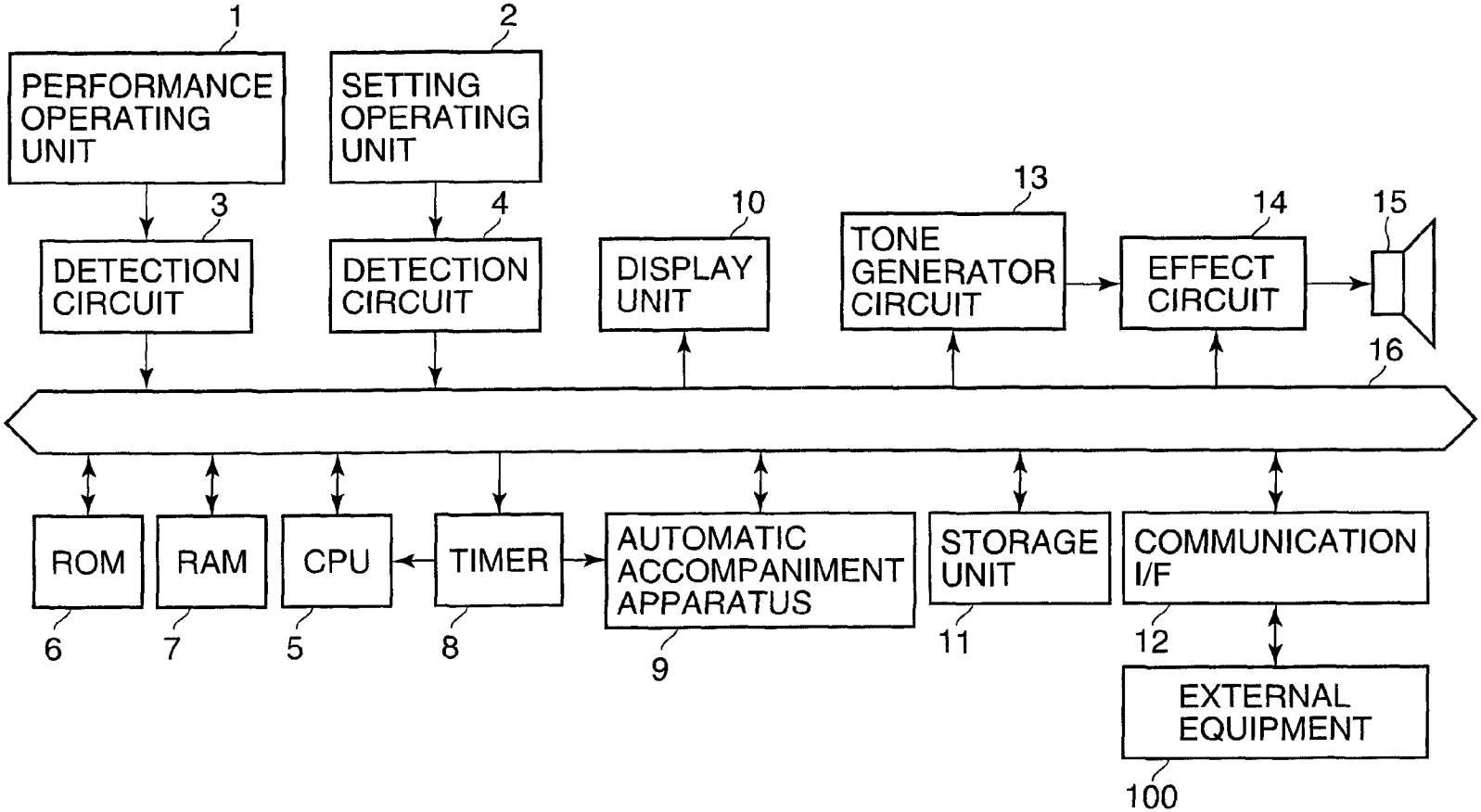
FIG. 1 is a block diagram schematically showing the construction of an electronic musical instrument having a chord detection apparatus according to one embodiment of this invention.

FIG. 1 schematically shows in block diagram the construction of an electronic musical instrument having a chord detection apparatus according to one embodiment of this invention.

As shown in FIG. 1, the electronic musical instrument of this embodiment includes a performance operating unit 1 that includes a keyboard for inputting performance data (including tone pitch information) in accordance with a user's performance operation, a setting operating unit 2 that includes switches and rotary encoders for inputting various information, a detection circuit 3 for detecting an operation state of the performance operating unit 1, a detection circuit 4 for detecting an operation state of the setting operating unit 2, a CPU 5 for controlling the entire electronic musical instrument, a ROM 6 that stores a control program executed by the CPU 5, various table data, etc., a RAM 7 for temporally storing performance data, various input information, arithmetic result, etc., and a timer 8 for measuring various times such as an interruption time in a timer interruption process.

The electronic musical instrument also includes an automatic accompaniment apparatus 9 for generating performance data (used to generate accompaniment tones) based on chord information supplied from the CPU 5, a display unit 10 that has, e.g., an LCD (liquid crystal display) and LEDs (light emitting diodes) for displaying various information, and a storage unit 11 that stores various application programs including the control program and various data such as various music data.

The electronic musical instrument further includes a communication interface (I/F) 12 connected to an external equipment 100 such as an external MIDI (musical instrument digital interface) equipment for transfer and reception of data to and from the external equipment 100, a tone generator circuit 13 for converting performance data input from the performance operating unit 1 into a musical tone signal and converting performance data generated by the automatic accompaniment apparatus 9 into a musical tone signal, an effect circuit 14 for adding various effects to the musical tone signal output from the tone generator circuit 13, and a sound system 15 that includes a DAC (digital-to-analog converter), amplifier, speaker, etc. for converting the musical tone signal output from the effect circuit 14 into sound.

The above-described elements 3 to 14 are connected to one another through a bus 16. The timer 8 is connected to the CPU 5 and to the automatic accompaniment apparatus 9, the external equipment 100 is connected to the communication I/F 12, the tone generator circuit 13 is connected to the effect circuit 14, and the effect circuit 14 is connected to the sound system 15.

The automatic accompaniment apparatus 9 is realized by the CPU 5 by executing sequencer software stored in the ROM 6 or the like. The automatic accompaniment apparatus 9 generates performance data based on chord information supplied from the CPU 5, and supplies the generated performance data to the tone generator circuit 13 to generate accompaniment tones. The automatic accompaniment apparatus 9 has a function of generating performance data by reproducing accompaniment style data selected by a user from various accompaniment style data stored beforehand in the ROM 6 or the like. To achieve this function, the automatic accompaniment apparatus 9 reproduces the accompaniment style data based on time information supplied from the timer 8. Since the construction and function of the automatic accompaniment apparatus 9 do not constitute the gist of this invention, a further description thereof is omitted.

The storage unit 11 is comprised of a storage medium (such as a flexible disk, hard disk, CD-ROM, DVD, optomagnetic disk, or semiconductor memory) and a drive unit for the storage medium. The storage medium can be configured so as to be detachable or undetachable from the drive unit, and the storage unit 11 can be configured to be detachable or undetachable from the electronic musical instrument. Since the control program can be stored in the storage unit 11, the CPU 5 can execute the control program by reading it into RAM 7 from the storage unit 11, if the control program is not stored in the ROM 6. The control program stored in the storage unit 11 can easily be version-upgraded.

In the illustrated example, the external equipment 100 is connected to the communication I/F 12, but this is not limitative. For example, a server computer can be connected to the communication I/F 12 through a communication network such as a LAN (local area network), Internet, or telephone line. In that case, the communication I/F 12 can be used to download programs and various parameters not stored in the storage unit 11 from the server computer. To this end, the electronic musical instrument transmits a request for the downloading of the program and parameters to the server computer through the communication I/F 12 and the communication network, the server computer distributes the requested program and parameters to the electronic musical instrument through the communication network, and the electronic musical instrument receives the program and parameters through the communication I/F 12 and stores them into the storage unit 11.

As understood from the foregoing description, the electronic musical instrument of this embodiment is configured as an electronic keyboard instrument, but this is not limitative. The electronic musical instrument can be configured by a general-purpose personal computer to which a keyboard is externally connected.

In the following, a description of the outline of a control process performed by the chord detection apparatus of the electronic musical instrument will be given with reference to FIGS. 2 to 4. Then, the details of the control process will be described with reference to FIGS. 5 to 10.

Figure 2A:
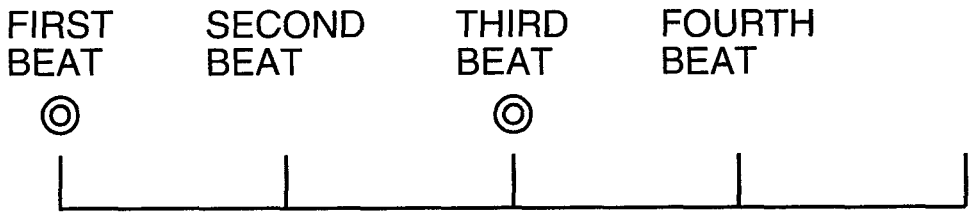
FIGS. 2A and 2B are views showing an example of the setting of a chord detection period.
Figure 2B:
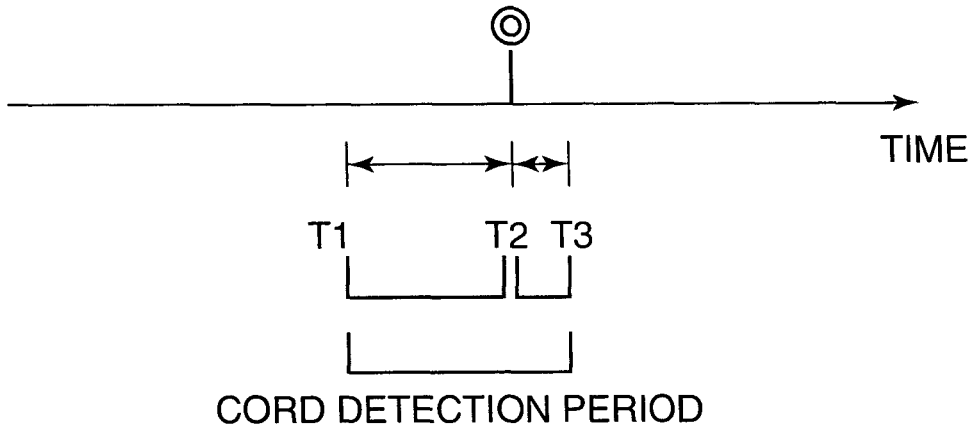

FIGS. 2A and 2B show an example of the setting of a chord detection period. In the example shown in FIGS. 2A and 2B, a piece of music written in four-four time is selected as performance music, chord-detection reference positions (each shown by a double-circle mark) are set at the first and third beats in each bar, and a time period from a time point T1 250 msec ahead of a reference time point T2 (corresponding to one of the chord-detection reference positions) to a time point T3 50 msec behind the reference time point T2 is set as a chord detection period (chord detection timing). In FIG. 2B, only the chord detection period around the third beat is shown, with an illustration of the same chord detection period around the first beat omitted.

The electronic musical instrument of this embodiment is configured to supply performance data, which is realtime input during the user's performance on the keyboard, to the tone generator circuit 13 for sound production, and detect a chord musically related to the realtime input performance data, which is then supplied to the automatic accompaniment apparatus 9 for the production of accompaniment tones. The chord detection period is a time period during which performance data to be referred to for chord detection is input. In other words, only the performance data input within the chord detection period will be referred to for the detection of a reference chord (that serves as a chord to be used for the production of accompaniment tones).

In the chord detection, chord candidates represented by degree names are extracted by executing first, second, and third extraction processes (101), (102), and (103). The first extraction process (101) is for extracting one or more degree name candidates each having a function that can follow the reference chord (hereinafter, sometimes referred to as the function that can come next), the second extraction process (102) is for extracting one or more degree name candidates each corresponding to an interrupted cadence, and the third extraction process (103) is for extracting one or more degree name candidates each corresponding to a non-functional chord progression technique.

In the first extraction process (101), one or more functions that can follow the last detected chord function are all extracted, while referring to either a correspondence table between chord functions and degree names for major tonality, which is shown in FIG. 3A, or a correspondence table for minor tonality shown in FIG. 3B, whichever corresponding to a current tonality. Then, while referring to the correspondence table, degree names each having any of the extracted functions (not only belonging to diatonic scale chords but also belonging to chords other than diatonic scale chords) are all extracted and registered into a degree name list. However, in a case where a predetermined condition is fulfilled, degree names belonging to diatonic scale chords are not extracted in some cases. The details of the first extraction process (101) will be described later.

In the second extraction process (102), one or more degree name candidates corresponding to an interrupted cadence are all extracted and registered into the degree name list, while referring to either the correspondence table shown in FIG. 3A or that shown in FIG. 3B, whichever corresponds to the current tonality. The details of the second extraction process (102) will be described later.

In the third extraction process (103), one or more degree name candidates corresponding to a non-functional chord progression are all extracted and registered into the degree name list, while referring to either a listing of degree names appearing in a non-functional chord progression technique for major tonality, which is shown in FIG. 4A or a similar listing for minor tonality shown in FIG. 4B, whichever corresponds to the current tonality. The details of the third extraction process (103) will be described later.

Next, the degree names registered in the degree name list are developed into chord names based on the current tonality. Then, one of chords represented by the developed chord names is selected based on input performance data, and the selected chord is output for sound production to the automatic accompaniment apparatus 9. The selected chord is stored for use in the first to third extraction processes (101) to (103).

In the example shown in FIG. 2, the chord detection process for selecting a chord and for outputting the selected chord to the automatic accompaniment apparatus 9 is performed at the first beat and at the third beat. More specifically, performance data to be referred to in the chord detection process is detected within the chord detection period T1 to T3 and an instruction to start the chord detection process is given within the time period T3.

In the chord detection apparatus of this embodiment, chord candidates musically related to performance data, which is realtime input, are extracted as chords that can come next, and a chord consonant with the performance data is detected from the extracted chord candidates, as described above. It is therefore possible to detect a chord consonant with and musically related to the performance data that is realtime input.

Furthermore, since chord candidates each represented by a degree name are extracted and the extracted chord candidates are developed into chord names based on the current tonality, enharmonic chords differing in notation but alike in sound (e.g., "F♯Maj7" and "G♭Maj7") can be generated or developed so as to be capable of being distinguished from each other.

Since chords forming a non-functional chord progression (such as cliche, passing diminish, or parallel motion) are extracted as chord candidates, a wide variety of chord progressions can be obtained. Furthermore, different chord progressions can be obtained according to a slight difference in touch in user's performance, whereby interesting chord progressions can be provided.

Chords that can come next are normally extracted as chord candidates, and a normally prohibited chord progression (e.g., interrupted cadence) is extracted only when a break in the music is determined. Thus, a fresh chord progression unexpected by the user or listeners is provided at a break in the music. The interrupted cadence is a normally unused chord progression, in which dominant (D) proceeds to subdominant minor (SM) in major tonality, whereas dominant (D) proceeds to subdominant (S) in minor tonality. The above extraction of interrupted cadence coincides with the principle of music composition that an interrupted cadence be used at a break in the music.

In the following, the details of the control process executed by the chord detection apparatus of the electronic musical instrument will be described.

The electronic musical instrument of this embodiment has first and second performance modes serving as performance modes in a case where realtime performance is performed by the user. In the first performance mode, the musical instrument produces sounds according to performance data input by the user by using the performance operating unit 1, with the operation of the automatic accompaniment apparatus 9 disabled. In the second performance mode, the musical instrument produces sounds according to performance data input by the user by using the performance operating unit 1 and also produces sounds (accompaniment tones) according to performance data generated by the automatic accompaniment apparatus 9.

When the electronic musical instrument is power on, the first performance mode is selected. Subsequently, if the user gives an instruction for mode shift, a shift is made from the first performance mode to the second performance mode.

In this embodiment, features of this invention are all contained in the performance process with automatic accompaniment, and therefore, a description of the performance process without automatic accompaniment will be omitted. It should be noted that all the features of this invention can be contained in the performance process without automatic accompaniment. In that case, no accompaniment tones are produced. In the following, the term "performance process" refers to the performance process with automatic accompaniment.

The performance process mainly includes (1) a startup process, (2) an automatic accompaniment start process, (3) an automatic accompaniment stop process, (4) a note event process, (5) a process at the time of a break of the music being detected, and (6) a process at the time of arrival of the chord detection period.

The startup process (1) includes (11) a setting process before performance start, (12) a chord detection period and rule setting process, (13) an initialization process, and (14) a chord detection period setting process.

Figure 5A:
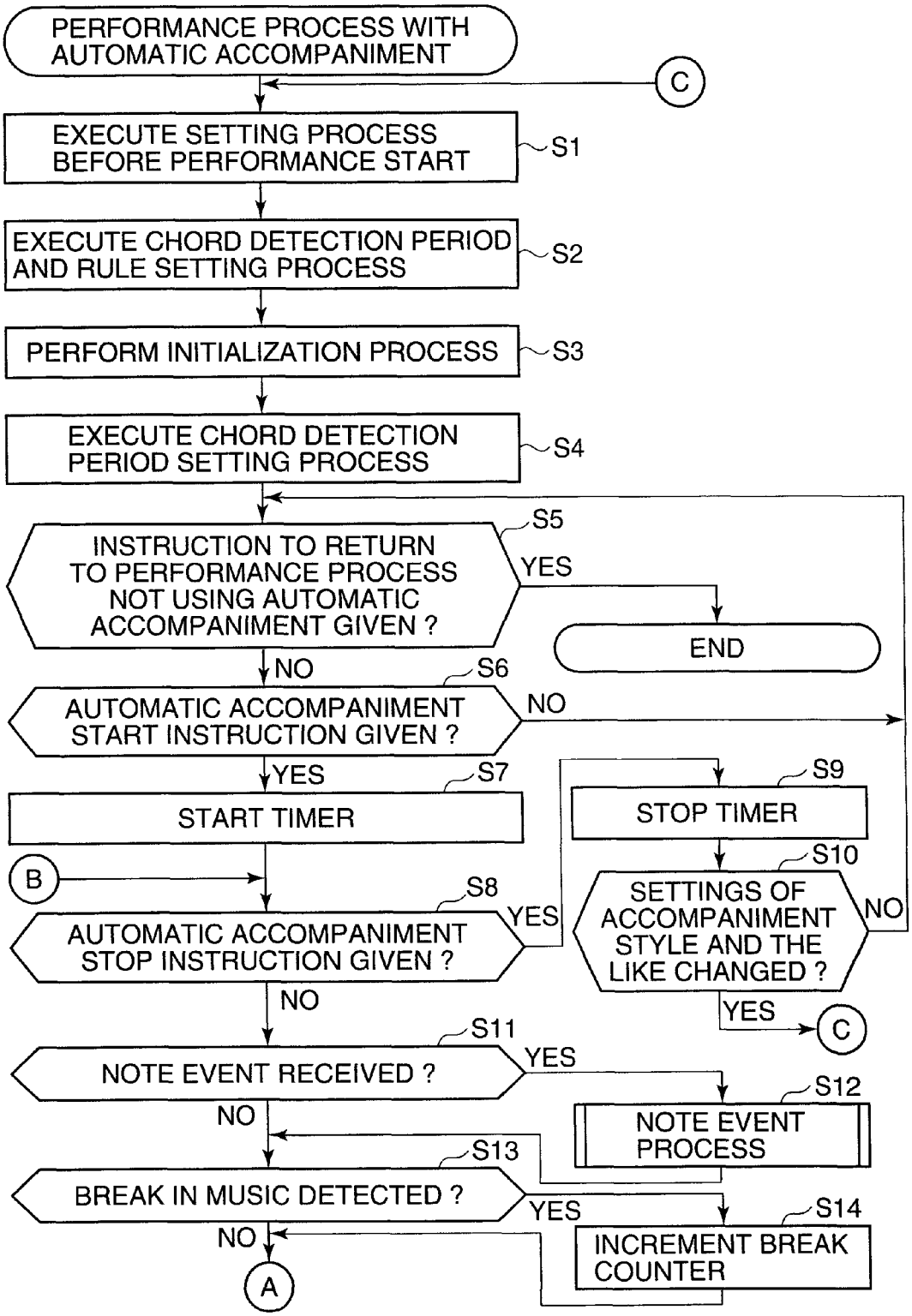
FIGS. 5A and 5B are a flowchart showing procedures of a performance process with automatic accompaniment, which is performed by a CPU of the electronic musical instrument shown in FIG. 1.
Figure 5B:
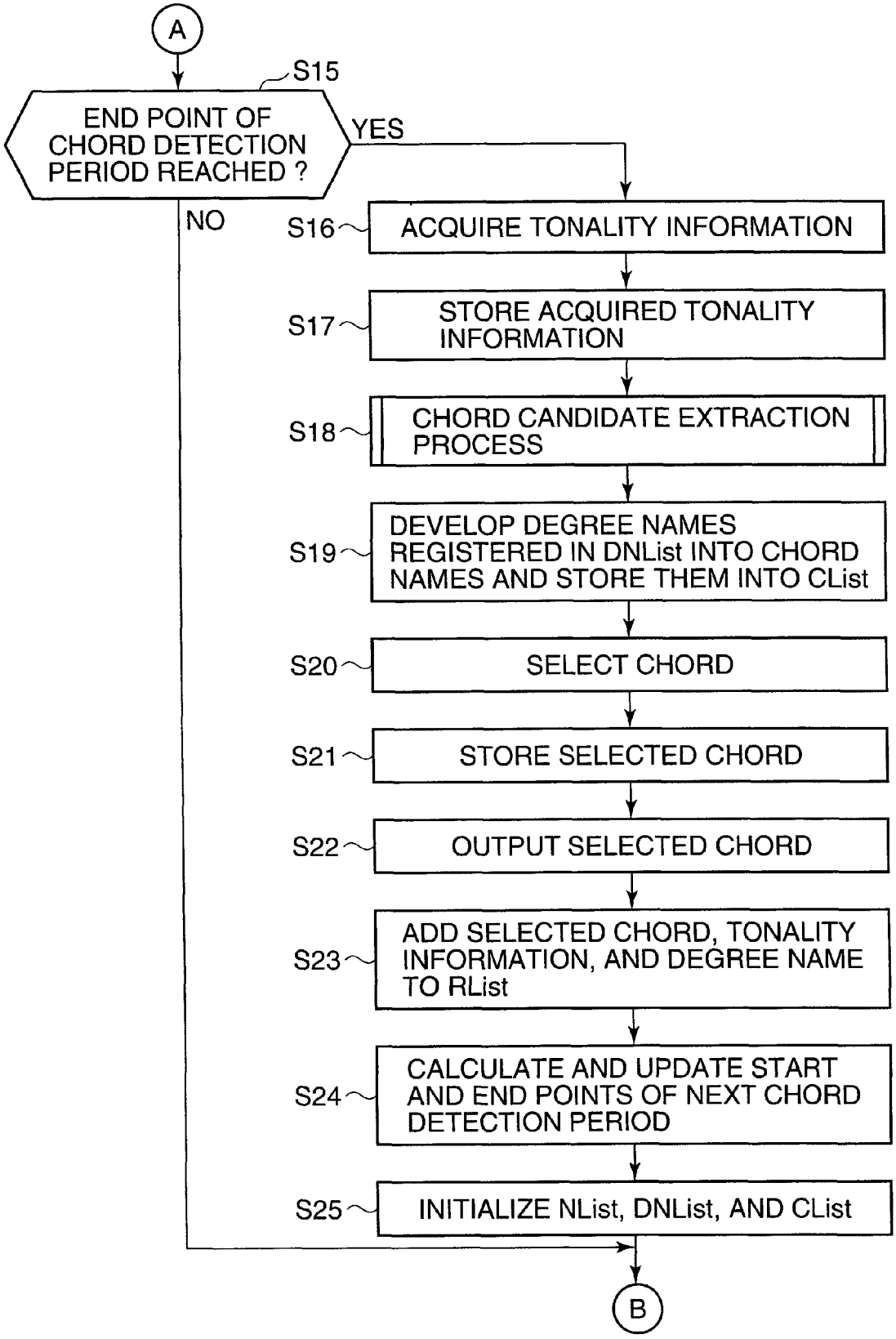

FIGS. 5A and 5B show in flowchart the procedures of the performance process with automatic accompaniment, which is executed by the CPU 5 of the electronic musical instrument. In the performance process, the CPU 5 executes the setting process before performance start (11) in which performance items such as tempo, beat, accompaniment style, volume value, and tone color are set (step S1). At that time, the CPU 5 can make an inquiry to the user about values or types to be set, and can set the performance items according to values or types input or selected by the user in reply to the inquiry. Alternatively, the CPU 5 can set the performance items by using default settings or last settings as they are or after being modified.

Next, the CPU 5 executes the chord detection period and rule setting process (12) in which a chord detection period (chord detection timing) and various rules are set (step S2).

To set the chord detection period (chord detection timing), the time width of the chord detection period is set to a value of 0 or set to a value other than 0.

In the case of the time width being set to a value other than 0, reference time points corresponding to the chord-detection reference positions, a time width of a front-half of the chord detection period preceding the reference time point, and a time width of a rear-half of the chord detection period subsequent to the reference time point are set. For example, as shown in FIGS. 2A and 2B, the first and third beats are set as chord-detection reference positions, and the time period from the time point T1 250 msec ahead of the time point T2 to the time point T3 50 msec behind the time point T2 is set as the chord detection period (chord detection timing).

In the illustrated example, the time width is set in units of msec, but this is not limitative. For example, the time width can be set in units of note length. The chord-detection reference position can be set not only at every other beat, but also at every beat. The setting at every other beat can be changed to the setting at every beat when there occurs a change in tempo, for example. The chord-detection reference position can also be set at a predetermined position (e.g., head position) in each bar other than beat positions, or can also be set to a position determined according to tempo or accompaniment style.

On the other hand, in the case of the time width being set to a value of 0, chord detection time points (chord detection timings) are set. For example, the chord detection time points can be set to, e.g., time points corresponding to the above-described various code detection reference positions (i.e., at predetermined beats or predetermined positions in each bar) or time points at each of which a predetermined operating element of the setting operating unit 2 is operated by the user. In this embodiment, it is assumed that the chord detection time period T1 to T3 shown in FIG. 2 is set as the chord detection timing.

As the various rules, there can be mentioned, for example, a tonality information detection rule (R1), a chord selection rule (R2), and a music break detection rule (R3).

As the tonality information detection rule (R1), there can be mentioned, for example, a rule stipulating that tonality information input by the user in reply to an inquiry made before the performance should be detected (acquired), and a rule stipulating that tonality information obtained by analyzing performance data input according to a user's performance operation should be detected as needed. It is assumed in this embodiment that tonality information represented by a key note name and major/minor is input or detected. A method for detecting tonality information by analyzing performance data is conventionally known. In the case of tonality information being detected as needed, it is preferable to store tonality information detected each time a chord is selected, so as to be associated with the selected chord.

As the chord selection rule (R2), there can be mentioned, for example, a rule (R2*a*) stipulating that a chord having the highest priority should be selected from among chord candidates according to predetermined priority orders of chords (for example, tonic chords of diatonic scale chords have higher priorities), and a rule (R2*b*) stipulating that a chord should be selected that has the highest degree of coincidence between tones of performance data to be referred to and tones of chord candidates (e.g., coincidence is found between all the tones, or between three or more tones, or between two or more tones). It is possible to add to the rule (R2*b*) a condition that performance data to be referred to must include root tones of the chord candidates.

As the music break detection rule (R3), there can be mentioned, for example, a rule (R3*a*) stipulating that a break in the music should be detected when an instruction to reproduce data that belongs to a "fill-in" section of selected accompaniment style data is given, a rule (R3*b*) stipulating that a break in the music should be detected when user's performance is restarted after the performance is discontinued over two or more bars, and a rule (R3*c*) stipulating that a break in the music should be detected when another accompaniment style data is selected.

In the chord detection period and rule setting process (12), it is possible to set whether or not the interrupted cadence in major tonality should be permitted even at the normal time. The term "permitted even at the normal time" refers to that a chord progression from dominant (D) to subdominant minor (SM) (i.e., interrupted cadence in major tonality) is permitted to be extracted not only in the second extraction process (102) to extract degree name candidates corresponding to the interrupted cadence, but also in the first extraction process (101) to extract degree name candidates each having a function that can come next.

In the case of the "permitted even at the normal time" setting being used, subdominant minor (SM) is added to the "function that can come next" field corresponding to function "D: dominant" in the correspondence table (shown in FIG. 3A) between chord functions and degree names for major tonality. As a result, there are indicated three types of functions "T, D, and SM" in the "function that can come next" field of the correspondence table. On the other hand, in the case of the "permitted even at the normal time" setting not being used, "SM" is not added to the "function that can come next" field, and there are indicated two types of functions "T and D" in that field. In the "function that can come next" field, "SM" is enclosed within parentheses to indicate that there are cases where "SM" is selected as the function that can come next and where "SM" is not selected as that function.

In this embodiment, the correspondence table shown in FIG. 3A is stored in the ROM 6 and referred to as needed. However, it is cumbersome to determine, while referring to the correspondence table, whether "SM" should be selected as the "function that can come next" on the basis of whether or not the "permitted even at the normal time" setting should be used. To obviate this, correspondence tables for cases where the "permitted even at the normal time" setting is used and where such setting is not used can be separately stored in the ROM 6, so that a required one of these two correspondence tables can be referred to as needed.

In the chord detection period and rule setting process (12), as with the setting process before performance start (11), the CPU 5 can make an inquiry to the user about contents to be set and can set the contents input or selected by the user in reply to the inquiry. Alternatively, the CPU 5 can set the contents by using default settings or last settings as they are or after being modified.

Referring to FIG. 5A again, the CPU 5 performs the initialization process (13) in which the following regions (13*a*) to (13*k*) of the RAM 7 are initialized (step S3).

The region (13*a*) is a region stored with a note event list NList in which note event information (tone pitch and input timing) corresponding to note-on events input within the chord detection period are registered. The region (13*b*) is a break counter constituted by a software counter incremented by 1 each time a break in the music is detected. The region (13*c*) is a region for storing a start point sTime of the chord detection period. The region (13*d*) is a region for storing an end point eTime of the chord detection period. The region (13*e*) is a region for storing tonality information Key detected according to a tonality detection rule. The region (13*f*) is a region for storing a degree name list DNList in which degree names of chord candidates extracted in a chord candidate extraction process (described later) are registered. The region (13*g*) is a region for storing a chord list CList in which chord names are registered, which are generated by developing, according to the tonality information Key, the degree names registered in the degree name list DNList. The region (13*h*) is a region for storing one chord name (i.e., the selected chord) selected from the chord list CList according to the note event information registered in the note event list NList. The region (13*i*) is a region for storing an output result list RList in which the selected chord, tonality information Key, and degree name corresponding to the selected chord are stored. The region (13*j*) is a region for storing a last degree name LDN corresponding to a last selected chord. The region (13*k*) is a region for storing a last function LF corresponding to the last selected chord.

Next, the CPU 5 executes the chord detection period setting process (14) in step S4. Specifically, the CPU 5 calculates the start point and the end point of a first chord detection period according to the chord detection period setting rule, and stores (sets) the calculated start and end points into the regions (13*c*), (13*d*) of the RAM 7, respectively.

In this embodiment, the start point T1 of the chord detection period is 250 msec ahead of the reference time point T2 corresponding to the top beat (chord-detection reference position). Thus, the start point of the chord detection period precedes the start of the music, but does not cause a problem since the control process is started upon start of the music.

Next, the CPU 5 determines whether an instruction to return to the performance process not using an automatic accompaniment (first performance mode) is given (step S5), and if the answer to step S5 is YES, completes the performance process. On the other hand, if the answer to step S5 is NO, the CPU 5 determines whether an automatic accompaniment start instruction is given (step S6), and if the answer to step S6 is NO, returns to step S5.

On the other hand, when determining in step S6 that an automatic accompaniment start instruction is given, the CPU 5 executes the automatic accompaniment start process (2). Specifically, the CPU 5 starts the timer 8 to start a time measurement (step S7). Time measurement information from the timer 8 is supplied to the automatic accompaniment apparatus 9. In a case that accompaniment style data has been set, the automatic accompaniment apparatus 9 reproduces, independently of the performance process, the accompaniment style data according to the time measurement information supplied from the timer 8.

Next, the CPU 5 determines whether a user's automatic accompaniment stop instruction is given (step S8). If the answer to step S8 is YES, the CPU 5 executes the automatic accompaniment stop process (3) to stop the timer 8 (step S9). As a result, the automatic accompaniment apparatus 9 stops reproducing the accompaniment style data. Next, whether the settings of accompaniment style, etc. are changed is determined (step S10). The process returns to step S1, if the answer to step S10 is YES, and returns to step S5, if the answer to step S10 is NO.

When determining in step S8 that the automatic accompaniment stop instruction is not given, the CPU 5 determines whether it receives a note event (step S11). If the answer to step S11 is YES, the CPU 5 executes the note event process (4) in step S12.

Figure 6:
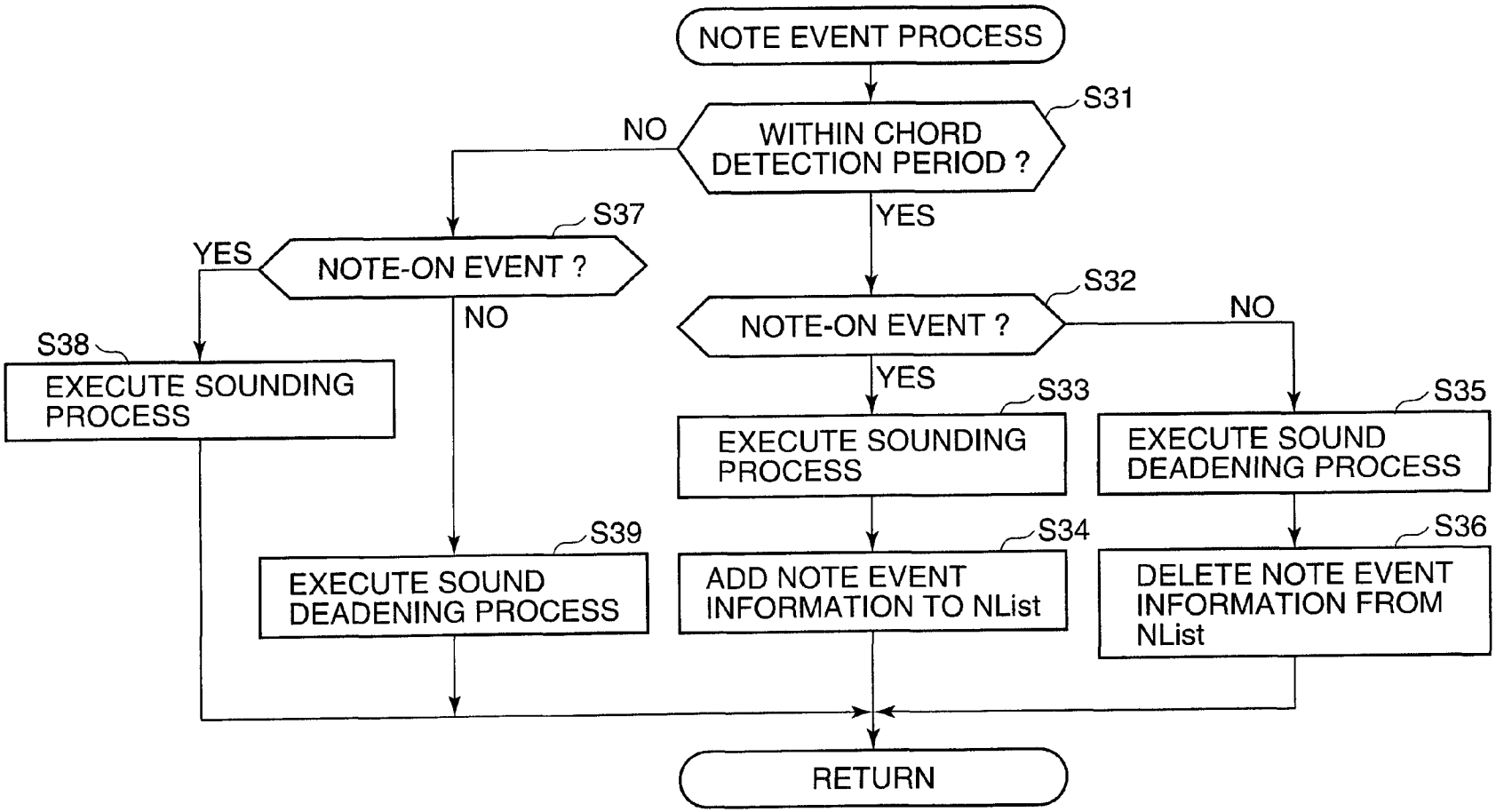
FIG. 6 is a flowchart showing procedures of a note event process shown in FIG. 5A.

FIG. 6 shows in flowchart the procedures of the note event process (4).

As shown in FIG. 6, the note event process (4) includes a process (41*a*) for a case where a note-on event is received within the chord detection period (steps S33 and S34), a process (41*b*) for a case where a note-off event is received within the chord detection period (step S35 and S36), a process (42*a*) for a case where a note-on event is received outside the chord detection period (step S38), and a process (42*b*) for a case where a note-off event is received outside the chord detection period (step S39).

In the note event process, the CPU 5 determines whether the current time point is within the chord detection period, while referring to the timer 8 (step S31). If the current time point is outside the chord detection process, the CPU 5 determines whether it receives a note-on event (step S37). If the answer to step S37 is YES, the CPU 5 executes the process (42*a*), i.e., a sounding process to output the received note-on event to the tone generator circuit 13 (step S38). On the other hand, if the answer to step S37 is NO (i.e., if a note-off event is received), the CPU 5 executes the process (42*b*), i.e., a sound deadening process to output the received note-off event to the tone generator circuit 13 (step S39).

When determining in step S31 that the current time point is within the chord detection period, the CPU 5 determines whether it receives a note-on event (step S32). If the answer to step S32 is YES, the CPU 5 executes the process (41*a*), i.e., a sounding process to output the received note-on event to the tone generator circuit 13 and a process to add note event information (tone pitch and input timing) corresponding to the note-on event to the note event list NList (steps S33 and S34). On the other hand, if the answer to step S32 is NO, the CPU 5 executes the process (41*b*), i.e., a sound deadening process to output the received note-off event to the tone generator circuit 13 and a process to delete note event information corresponding to the note-off event from the note event list NList (steps S35 and S36).

Referring to FIG. 5A again, when determining in step S11 that the CPU 5 does not receive a note event or after completing the note event process in step S12, the CPU determines whether or not it detects a break in the music (step S13). If the answer to step S13 is NO, the process proceeds to step S15 shown in FIG. 5B. On the other hand, if the answer to step S13 is YES, the CPU 5 executes the process (5) at the time of a break of the music being detected (step S14), in which the break counter is incremented by 1. Then, the process proceeds to step S15.

In step S15, the CPU 5 determines whether or not the end point eTime of the chord detection period is reached, while referring to the timer 8. If the answer to step S15 is YES, the CPU 5 starts the process at the time of arrival of the chord detection period (6).

In the process (6), the CPU 5 acquires, in step S16, tonality information Key according to the tonality detection rule set in the chord detection period and rule setting process (12), stores the acquired tonality information Key into the region (13*e*) of the RAM 7 in step S17, and executes a chord candidate extraction process in step S18.

Figure 7A:
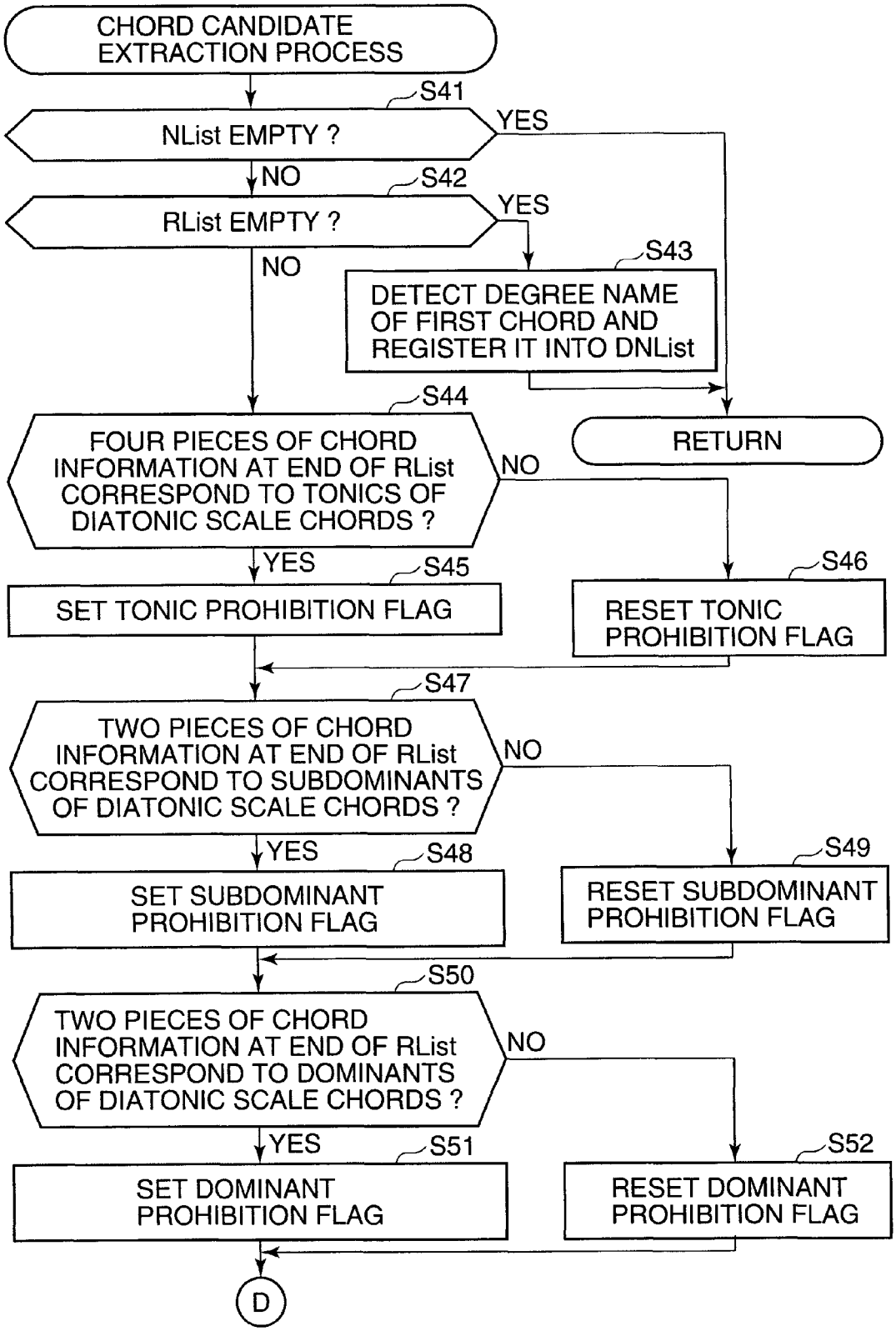
FIGS. 7A and 7B are a flowchart showing procedures of a chord candidate extraction process shown in FIG. 5B.
Figure 7B:
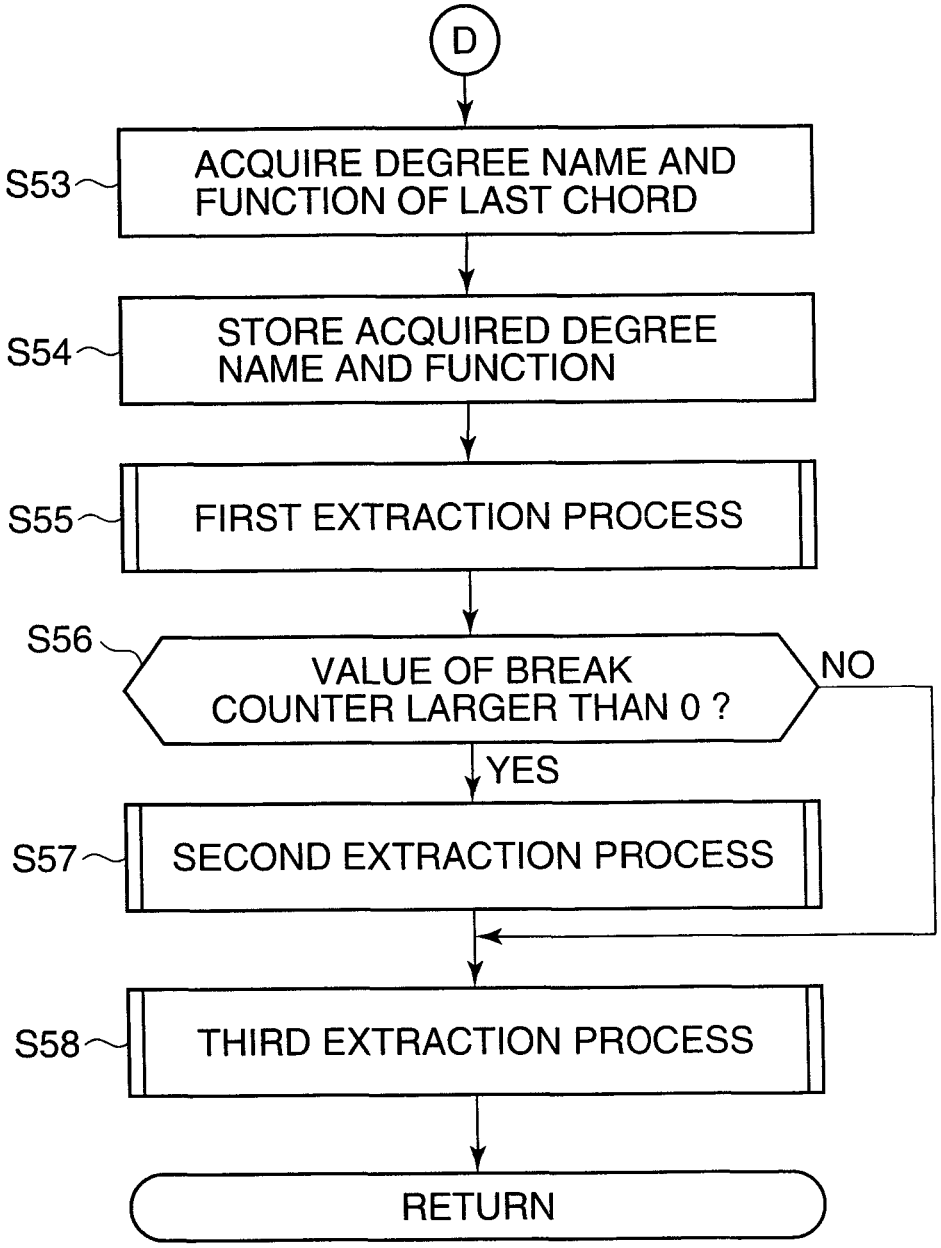

FIGS. 7A and 7B show, in flowchart, procedures of the chord candidate extraction process.

The chord candidate extraction process mainly includes a startup process (100*a*), a preparatory process (100*b*) for the first extraction process (101), and the first to third extraction processes (101) to (103).

In the chord candidate extraction process, the startup process (100*a*) is first executed, in which the CPU 5 determines whether the note event list NList is empty (step S41). If the answer to step S41 is YES (i.e., if no note event information is recorded in the note event list NList), the CPU 5 completes the chord candidate extraction process, and returns to the performance process. On the other hand, if the answer to step S41 is NO, the CPU 5 determines whether the output result list RList is empty (step S42). If the answer to step S42 is YES, the CPU 5 detects a degree name of a first chord according to the tonality information Key and the note event information recorded in the note event list NList, registers the detected degree name into the degree name list DNList (step S43), and completes the chord candidate extraction process.

The degree name of the first chord can be detected by an ordinary method. Since a last chord serving as a reference chord to be referred to has not been stored as yet when the degree name of the first chord is detected, a tonic chord in major tonality or minor tonality having as a root a key note of that tonality, for example, can be used as the reference chord.

When determining in step S42 that the output result list RList is not empty, the CPU 5 executes the preparatory process (100*b*) in which a tonic prohibition flag, subdominant prohibition flag, and dominant prohibition flag are set or reset. More specifically, the CPU 5 determines whether four or more pieces of chord information are registered in the output result list RList, and if so, further determines whether all the four pieces of chord information at the end of the output result list RList (i.e., all the four pieces of chord information last registered into the output result list RList) each correspond to any of tonics (T) of diatonic scale chords (step S44). The CPU 5 sets the tonic prohibition flag to a value of 1, if the answer to step S44 is YES (step S45), and resets the tonic prohibition flag to a value of 0, if the answer to step S44 is NO (step S46).

Next, the CPU 5 determines whether two or more pieces of chord information are registered in the output result list RList, and if so, further determines whether all the two pieces of chord information at the end of the output result list RList each correspond to any of subdominants (S) of diatonic scale chords (step S47). The CPU 5 sets the subdominant prohibition flag to a value of 1, if the answer to step S47 is YES (step S48), and resets the subdominant prohibition flag to a value of 0, if the answer to step S47 is NO (step S49).

Next, the CPU 5 determines whether two or more pieces of chord information are registered in the output result list RList, and if so, further determines whether all the two pieces of chord information at the end of the output result list RList each correspond to any of dominants (D) of diatonic scale chords (step S50). The CPU 5 sets the dominant prohibition flag to a value of 1, if the answer to step S50 is YES (step S51), and resets the dominant prohibition flag to a value of 0, if the answer to step S50 is NO (step S52).

A case where one of the three types of prohibition flags is reset to a value of 0 corresponds to steps S20 to S23 in FIG. 5B in which a diatonic scale chord having a function corresponding to that flag is continuously selected and sounded a predetermined number of times. On the other hand, each prohibition flag being set to a value of 1 prevents a diatonic scale chord having a corresponding function from being continuously selected more than the predetermined number of times (see, steps S63 and S67 in FIG. 8A and step S71 in FIG. 8B). Thus, the prohibition flags suppress monotonous chords from being selected and sounded. The number of times for which the same diatonic scale chord is continuously selected (so that a further selection of that chord is prohibited) is not limited to the above-described number of times, i.e., two or four times.

Next, the CPU 5 acquires a degree name and function of a last chord, while referring to the chord information at the end of the output result list RList (step S53), and stores the acquired degree name as the last degree name LDN into the region (13*j*) of the RAM 7 and stores the acquired function as the last function LF into the region (13*k*) of the RAM 7 (step S54).

Next, the CPU 5 executes the first extraction process (101) to extract degree name candidates each having a function that can come next (step S55).

Figure 8A:
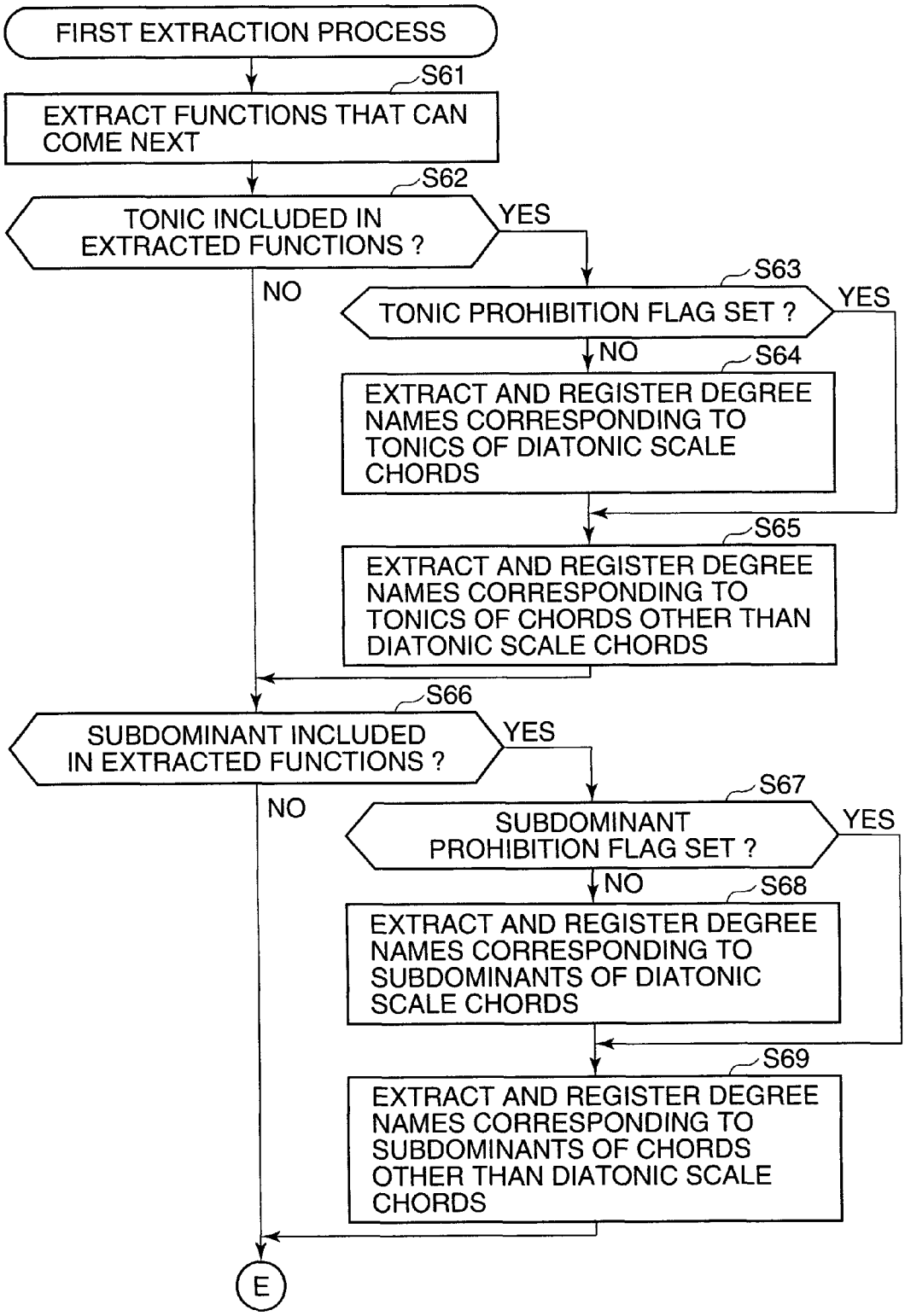
FIGS. 8A and 8B are a flowchart showing procedures of a first extraction process shown in FIG. 7B.
Figure 8B:
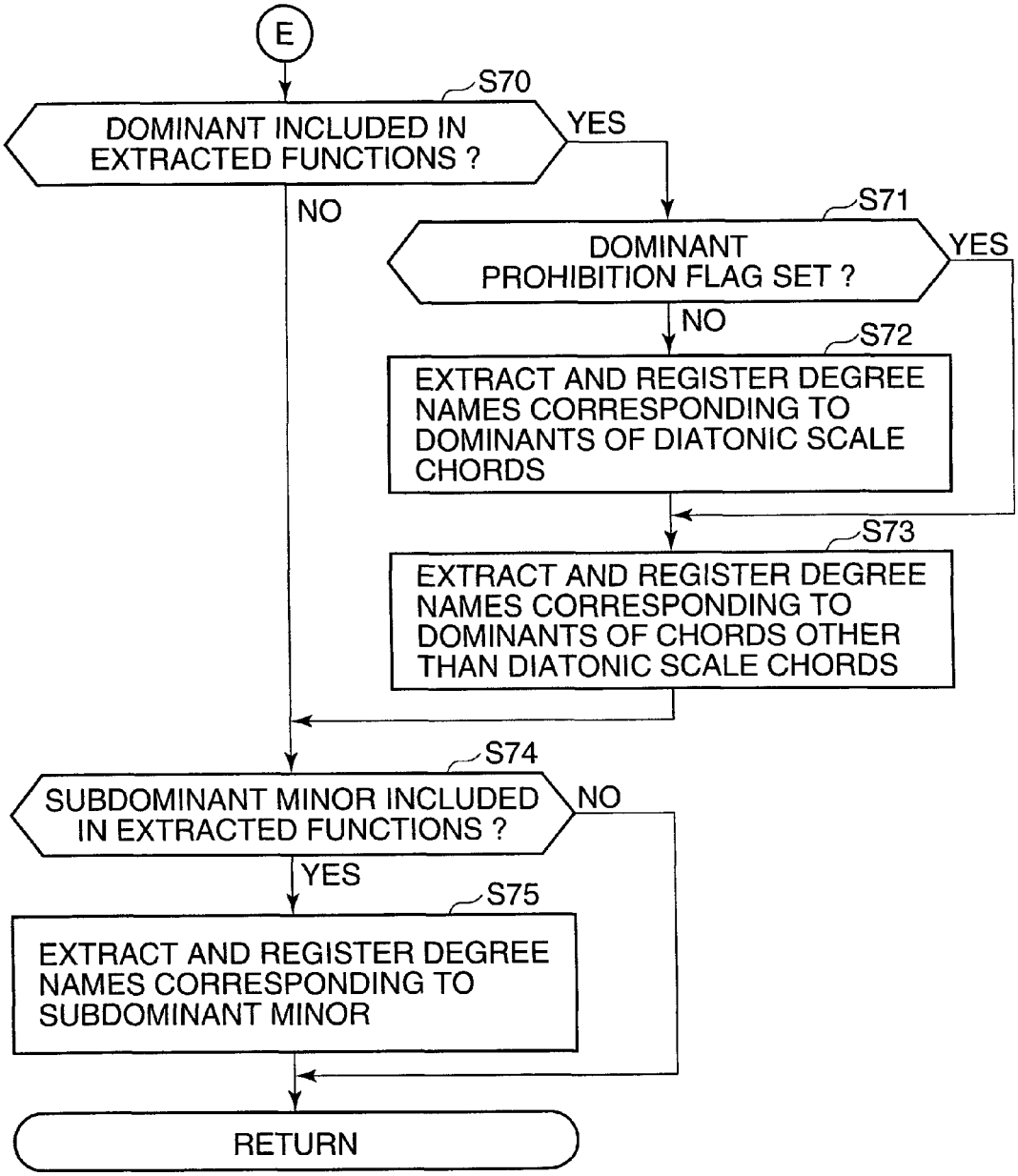

FIGS. 8A and 8B show in flowchart the procedures of the first extraction process (101).

In the first extraction process (101), the CPU 5 extracts all functions that can come next based on the last function LF and the tonality information Key (step S61), while referring to the correspondence table shown in FIG. 3A between chord functions and degree names, if the tonality information Key indicates a major tonality, and on the other hand, while referring the correspondence table shown in FIG. 3B, if the tonality information Key indicates a minor tonality.

In a case, for example, that the last function LF is tonic (T) and the tonality information Key indicates a major tonality, the CPU 5 selects tonic (T), subdominant (S), dominant (D), and subdominant minor (SM) as the functions that can come next. In a case where the last function LF is dominant (D) and the tonality information Key indicates a major tonality, the CPU 5 extracts tonic (T), dominant (D), and subdominant minor (SM) as the functions that can come next, if the "permitted even at the normal time" setting is used to permit the progress from dominant (D) to subdominant minor (SM) in major tonality (i.e., interrupted cadence in major tonality), and if the "permitted even at the normal time" setting is not used, extracts tonic (T) and dominant (D) as the functions that can come next.

Next, the CPU 5 determines whether tonic is included in the extracted functions (step S62). If the answer to step S62 is NO, the process proceeds to step S66. If the answer to step S62 is YES, the CPU 5 determines whether the tonic prohibition flag is set to a value of 1 (step S63).

If the answer to step S63 is YES, the process proceeds to step S65. If the answer to step S63 is NO (i.e., if the flag is reset to a value of 0), the CPU 5 extracts all degree names conforming to the tonality information Key from among degree names corresponding to tonics of diatonic scale chords, and registers the extracted degree names into the degree name list DNList (step S64). Then, the CPU 5 extracts all degree names conforming to the tonality information Key from among degree names corresponding to tonics of chords other than diatonic scale chords, and registers the extracted degree names into the degree name list DNList (step S65).

In step S66, the CPU 5 determines whether subdominant is included in the extracted functions. If the answer to step S66 is NO, the process proceeds to step S70. If the answer to step S66 is YES, the CPU 5 determines whether the subdominant prohibition flag is set to a value of 1 (step S67).

If the answer to step S67 is YES, the process proceeds to step S69. If the answer to step S67 is NO (i.e., if the flag is reset to a value of 0), the CPU 5 extracts all degree names conforming to the tonality information Key from among degree names corresponding to subdominants of diatonic scale chords, and registers the extracted degree names into the degree name list DNList (step S68). Then, the CPU 5 extracts all degree names conforming to the tonality information Key from among degree names corresponding to subdominants of chords other than diatonic scale chords, and registers the extracted degree names into the degree name list DNList (step S69).

In step S70, the CPU 5 determines whether dominant is included in the extracted functions. If the answer to step S70 is NO, the process proceeds to step S74. If the answer to step S74 is YES, the CPU 5 determines whether the dominant prohibition flag is set to a value of 1 (step S71).

If the answer to step S71 is YES, the process proceeds to step S73. If the answer to step S71 is NO (i.e., if the flag is reset to a value of 0), the CPU 5 extracts all degree names conforming to the tonality information Key from among degree names corresponding to dominants of diatonic scale chords, and registers the extracted degree names into the degree name list DNList (step S72). Then, the CPU 5 extracts all degree names conforming to the tonality information Key from among degree names corresponding to dominants of chords other than diatonic scale chords, and registers the extracted degree names into the degree name list DNList (step S73).

In step S74, the CPU 5 determines whether subdominant minor is included in the extracted functions. If the answer to step S74 is NO, the process returns to the chord candidate extraction process. If the answer to step S74 is YES, the CPU 5 extracts all degree names conforming to the tonality information Key from among degree names corresponding to subdominant minor, and registers the extracted degree names into the degree name list DNList (step S75), whereupon the process returns to the chord candidate extraction process.

Referring to FIG. 7B again, after completion of the first extraction process (101) of the chord candidate extraction process, the CPU 5 determines whether a value of the break counter is larger than 0 (step S56). If the answer to step S56 is NO, the process proceeds to step 58. If the value of the break counter is larger than 0, the CPU 5 executes the second extraction process (102) to extract degree name candidates corresponding to the interrupted cadence (step S57).

Figure 9:
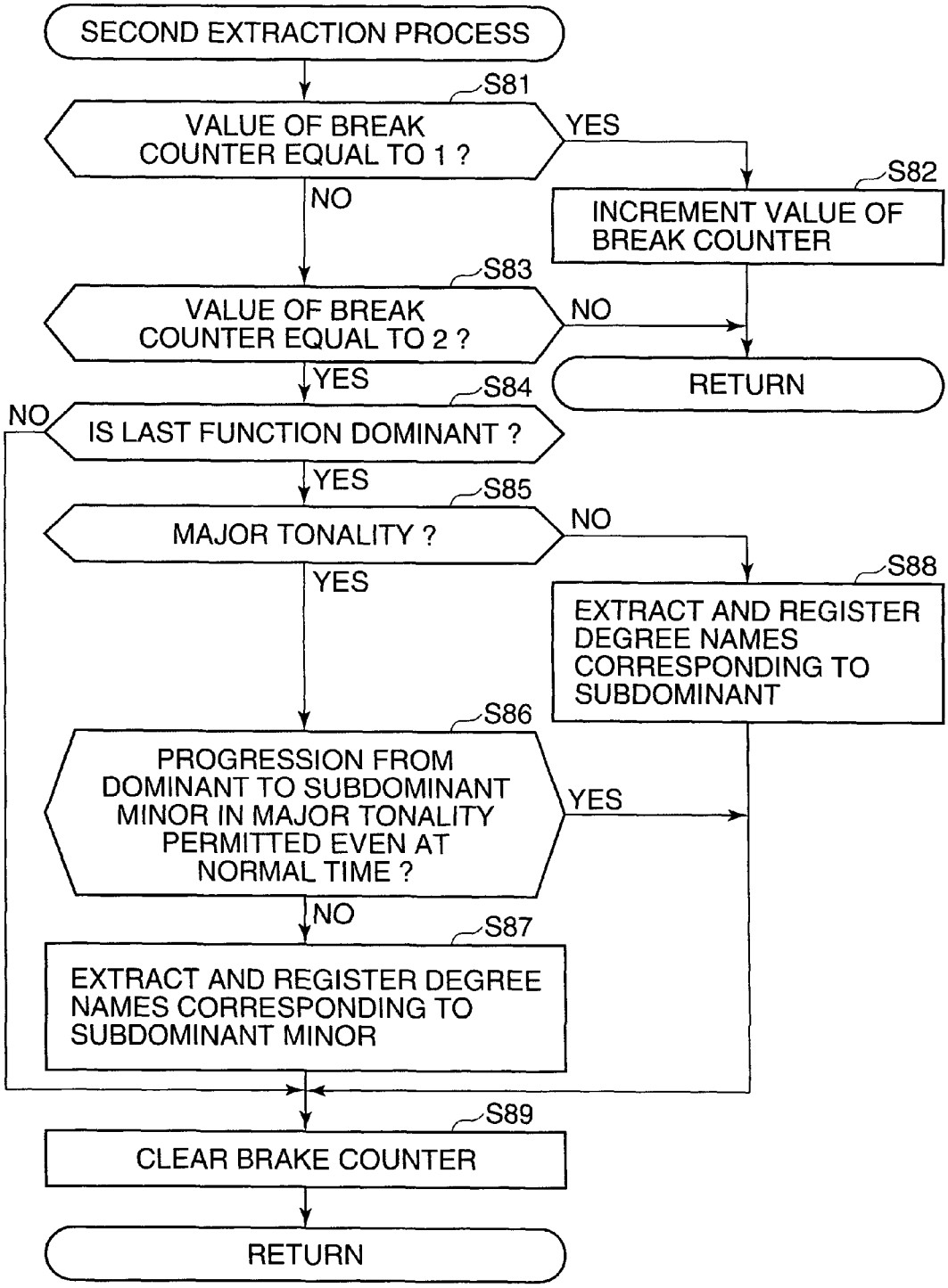
FIG. 9 is a flowchart showing procedures of a second extraction process shown in FIG. 7B.

FIG. 9 shows in flowchart the procedures of the second extraction process (102).

In the second extraction process (102), the CPU 5 determines whether a value of the break counter is equal to 1 (step S81), and if the answer to step S81 is YES, increments the value of the break counter by 1 (step S82). Then, the CPU 5 completes the extraction process (102). On the other hand, if the answer to step S81 is NO, the CPU 5 determines whether the value of the break counter is equal to 2 (step S83), and if the value of the break counter is equal to 0 or equal to 3 or larger, completes the second extraction process (102), whereupon the process returns to the chord candidate extraction process.

When determining in step S83 that the value of the break counter is equal to 2, the CPU 5 determines whether the last function LF is dominant (step S84). If the answer to step S84 is NO, the process proceeds to step S89. If the answer to step S84 is YES, the CPU 5 determines whether the tonality information Key indicates a major tonality (step S85).

When determining in step S85 that the tonality information Key indicates a minor tonality (i.e., if the answer to step S85 is NO), the CPU 5 extracts all degree names conforming to the tonality information Key from among degree names corresponding to subdominant, and registers the extracted degree names into the degree name list DNList (step S88). At that time, while referring to the correspondence table (shown in FIG. 3B) between chord functions and degree names in minor tonality, the CPU 5 extracts all degree names each having a subdominant chord function in a chord progression from dominant to subdominant in minor tonality (i.e., in an interrupted cadence in minor tonality).

If the answer to step S85 is Yes, i.e., if the tonality information Key indicates a major tonality, the CPU 5 determines whether a chord progression from dominant to subdominant minor in major tonality (i.e., an interrupted cadence in major tonality) is permitted even at the normal time (step S86).

If the answer to step S86 is NO (i.e., if an interrupted cadence in major tonality is not permitted at the normal time), the CPU 5 extracts all degree names conforming to the tonality information Key from among degree names corresponding to subdominant minor, and registers the extracted degree names into the degree name list DNList (step S87). At that time, while referring to the correspondence table (shown in FIG. 3A) between chord functions and degree names in major tonality, the CPU 5 extracts all degree names each having a subdominant minor chord function in a chord progression from dominant to subdominant minor in major tonality (i.e., in interrupted cadence in major tonality).

On the other hand, if the answer to step S86 is YES (i.e., if the chord progression from dominant to subdominant minor (interrupted cadence) in major tonality is permitted even at the normal time, the CPU 5 skips step S87. This is because degree names each having a subdominant minor chord function are already registered in the degree name list DNList in step S75 in FIG. 8B. Even in this case, such degree names can be registered again into the degree name list DNList in step S87.

In step S89, the CPU 5 clears the break counter. Then, the process returns to the chord candidate extraction process.

As described above, the second extraction process (102) is executed only when the value of the break counter is equal to 2. This is because the last function LF acquired when the end point eTime of the first chord detection period is reached (i.e., when the value of the break counter is equal to 1) is a function used before the break in the music is detected, which makes it difficult to properly extract degree name candidates corresponding to the interrupted cadence, and because the last function LF acquired when the end point eTime of the next chord detection period is reached (i.e., when the value of the break counter is equal to 2) is a function used after the break in the music is detected, so that degree name candidates corresponding to the interrupted cadence can be extracted properly.

Referring to FIG. 7B again, after completion of the second extraction process (102) of the chord candidate extraction process, the CPU 5 executes the third extraction process (103) in which degree name candidates corresponding to a non-functional chord progression technique are extracted (step S58).

Figure 10:
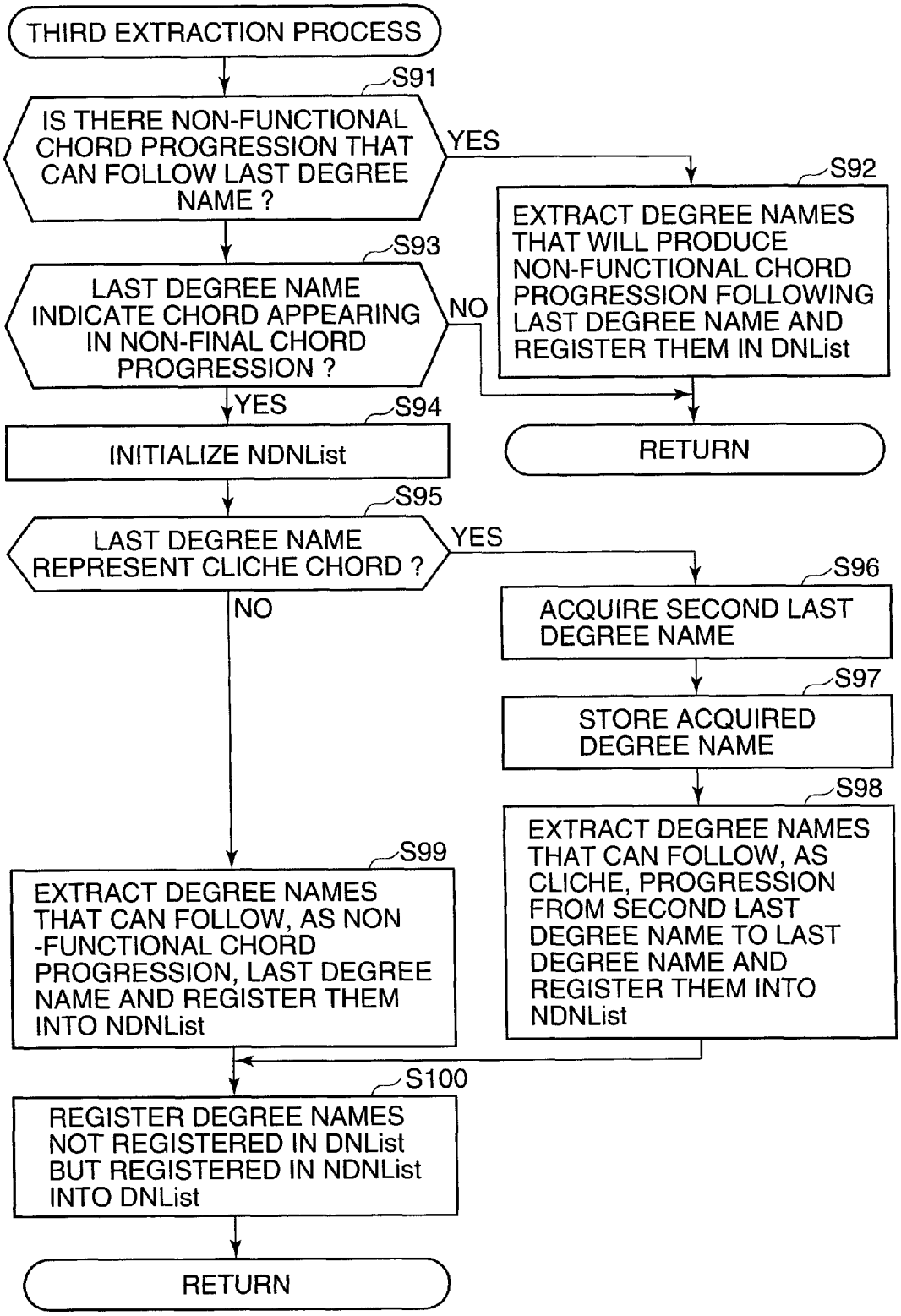
FIG. 10 is a flowchart showing procedures of a third extraction process shown in FIG. 7B.

FIG. 10 shows in flowchart the procedures of the third extraction process (103).

In the third extraction process (103), the CPU 5 determines whether there is a non-functional chord progression that can follow the last degree name LDN (step S91). If the answer to step S91 is YES, the CPU 5 extracts all degree names that will produce a non-functional chord progression following the last degree name LDN and conforming to the tonality information Key, and registers the extracted degree names into the degree name list DNList (step S92). Then, the extraction process (103) is completed and returns to the performance process.

On the other hand, if the answer to step S91 is NO, the CPU 5 determines whether the last degree name LDN indicates a chord appearing in a non-functional chord progression (step S93). If the answer to step S93 is NO, the extraction process (103) is completed and returns to the performance process.

If the answer to step S93 is YES, the CPU 5 initializes the degree name list NDNList (step S94), and determines whether the last degree name represents a cliche chord (step S95). If the answer to step S95 is YES, the CPU 5 acquires a degree name of a second last chord, while referring to second last chord information in the output result list RList (step S96), and stores the acquired second last degree name into a region BDN in the RAM 7 (step S97). Hereinafter, the second last degree name stored in the region BDN will be referred to as the second last degree name BDN.

Next, the CPU 5 extracts all degree names that can follow (as cliche) a progression from the second last degree name BDN to the last degree name LDN, and registers the extracted degree names into a next degree name list NDNList (step S98), whereupon the process proceeds to step S100.

If the answer to step S95 is NO, the CPU 5 extracts all degree names that can follow (as a non-functional chord progression conforming to the tonality information Key) the last degree name LDN, and registers the extracted degree names into the next degree name list NDNList (step S99), whereupon the process proceeds to step S100.

In step S100, the CPU 5 registers degree names, which have been registered in the next degree name list NDNList but have not been registered in the degree name list DNList, into the degree name list DNList. Then, the process returns to the performance process.

In steps S92, S93, S95 and S99, the CPU 5 refers to the listing of degree names (shown in FIG. 4A) appearing in a non-functional chord progression for a case where the tonality information Key indicates a major tonality, or refers to the listing of degree names shown in FIG. 4B for a case where the tonality information Key indicates a minor tonality.

More specifically, in step S92, degree names are extracted according to a result of the determination to determine whether the last degree name LDN is included in a group of degree names indicated in the "Last" field of the listing corresponding to the tonality information Key. In a case, for example, that the last degree name LDN is IMaj7 and the tonality information Key indicates a major tonality, IMaj7 is included in the degree name group indicated in the "Last" field corresponding to the "Passing diminish" technique field of the listing of FIG. 4A and also included in the degree name group indicated in the "Last" field corresponding to the "Cliche" technique field of the listing of FIG. 4A. Thus, degree names "♯IDim, ♭IIIdim, and Iaug" indicated in the "Current" fields corresponding to the "Last" fields in each of which IMaj7 is included are extracted.

In step S93, whether the last degree name LDN indicates a chord appearing in a non-functional chord progression is determined according to a result of the determination to determine whether the last degree name LDN does not correspond to any of degree names, which are indicated in the "Current" filed of the listing corresponding to the tonality information Key.

In step S95, whether or not the last degree name is a cliche chord is determined according to a result of the determination to determine whether the last degree name LDN is the degree name "Iaug" indicated in the "Current" field that corresponds to the "Cliche" technique field of the listing corresponding to the major tonality.

In steps S96 to S98, it is determined whether the second last degree name BDN is included in which of the degree name groups indicated in the "Last" fields corresponding to the "Cliche" technique field, and a degree name, which is indicated in the "Next" field corresponding to one of the "Last" fields that includes the second last degree name BDN, is registered into the next degree name list NDNList.

However, in a case where the second last degree name BDN is "I" or "Isus4", the second last degree name BDN is included in both the "Last" fields corresponding to the "Cliche" technique field, making it impossible to determine the one "Last" field. In that case, a degree name indicated in both the "Last" fields is extracted and registered into the next degree name list NDNList.

In step S99, degree names each of which can follow the last degree name LDN are determined according to a result of the determination to determine whether the last degree name LDN corresponds to any of degree names, which are indicated in the "Current" field of the listing corresponding to the tonality information Key.

Referring to FIG. 5B again, after completion of the chord candidate extraction process, the process proceeds to step S19, in which the CPU 5 develops the degree names registered in the degree name list DNList into chord names according to the tonality information Key. At that time, the degree names are developed into chord names by calculating roots based on the degrees of the degree names, assuming that the key note of tonality information has I degree. For example, chord name "Gm7" is obtained by developing the degree name "IIm7" according to the tonality information "FMaj". The developed chord names are registered into the chord list CList.

Next, the CPU 5 selects a chord according to the note event list NList and the chord list CList (step S20). The chord selection is performed according to the chord selection rule (R2*a*) or (R2*b*) set in the chord detection period and rule setting process. The selected chord is stored into the region (13*h*) of the RAM 7 (step S21), and is output to the automatic accompaniment apparatus 9 (step S22).

Next, the CPU 5 adds the selected chord, tonality information Key, and degree name corresponding to the selected chord to the end of the output result list RList (step S23), calculates start and end points of the next chord detection period according to the setting rule, and updates the start point sTime and end point eTime stored in the regions (13*c*), (13*d*) of the RAM 7 to the calculated start and end points (step S24). The note event list NList, degree name list DNList, and chord list CList are initialized or cleared (step S25), whereupon the process returns to step S8.

In the above-described embodiment, a chord musically related to performance data input to the electronic musical instrument is detected, and automatic accompaniment is performed based on the detected chord, but this is not limitative. Based on the detected chord, harmony tones for the performance data can be generated.

In the above-described embodiment, after the start of the automatic accompaniment, the output result list RList is initialized only when the automatic accompaniment is stopped and the settings are changed (step S3 in FIG. 5A). In other words, the embodiment describes an example where the output result list RList is not normally initialized during the performance process with automatic accompaniment, so that almost all the chords detected after the start of the automatic accompaniment are registered. This is because of simplification of the description. A predetermined number of chords detected and stored in succession can be updated one by one each time a new chord is detected.

Detected chords can be stored in the form of chord names or in the form of degree names associated with tonality information or in both the forms. Detected chords stored in the form of chord names can each be converted into a degree name each time any of the chords is referred to.

In the above-described embodiment, performance data per se (which is input to the electronic musical instrument) is referred to at the time of chord detection, but this is not limitative. The accuracy of the chord detection can be improved by using, in the chord detection, performance data from which note data corresponding to grace notes and corresponding to tones supposed to be produced by unintended touches have been removed.

It is preferable, although not inevitably necessary, to configure that arbitrary chord types can additionally be registered by the user into the correspondence tables shown in FIGS. 3A and 3B and into the listing shown in FIGS. 4A and 4B.

It is to be understood that the present invention may also be accomplished by supplying a system or an apparatus with a storage medium in which a program code of software, which realizes the functions of the above described embodiment is stored and by causing a computer (or CPU or MPU) of the system or apparatus to read out and execute the program code stored in the storage medium.

In that case, the program code itself read from the storage medium realizes the functions of the above described embodiment, and therefore the program code and the storage medium in which the program code is stored constitute the present invention.

Examples of the storage medium for supplying the program code include a flexible disk, a hard disk, a magnetic-optical disk, a CD-ROM, a CD-R, a CD-RW, a DVD-ROM, a DVD-RAM, a DVD-RW, a DVD+RW, a magnetic tape, a nonvolatile memory card, and a ROM. The program code may be downloaded via a network.

Further, it is to be understood that the functions of the above described embodiment may be accomplished not only by executing the program code read out by a computer, but also by causing an OS or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

What is claimed is:

1. A chord detection apparatus comprising:

a performance data acquisition unit configured to acquire performance data according to a user's performance operation;

a tonality information acquisition unit configured to acquire tonality information in the performance data;

a chord-detecting timing setting unit configured to set a chord-detection reference position and a chord-detection timing falling within a predetermined timing range about the chord-detection reference position;

an instruction unit configured to detect the chord detection timing and give an instruction for chord detection;

a reference unit configured to refer to a reference chord;

an extraction unit configured to extract, according to the tonality information acquired by said tonality information acquisition unit, chord candidates that follow the reference chord referred to by said reference unit; and a selection unit configured to select a chord from the chord candidates extracted by said extraction unit according to the performance data acquired by said performance data acquisition unit when the instruction for chord detection is given by said instruction unit.

2. The chord detection apparatus according to claim 1, further including a storage unit configured to store the chord selected by said selection unit to said reference unit to refer the chord.

3. The chord detection apparatus according to claim 1, wherein said extraction unit determines a function of the reference chord based on the acquired tonality information, determines functions that follow the determined function of the reference chord, and extracts chords each having any of the determined functions, as the chord candidates.

4. The chord detection apparatus according to claim 1, further including:

a detection unit configured to detect a break in performance music, wherein said extraction unit extracts even a chord that produces an interrupted cadence, as a chord candidate, at a time of chord candidate extraction after the break being detected by said detection unit.

5. The chord detection apparatus according to claim 1, wherein said extraction unit determines a non-functional chord progression technique that follows the reference chord, and extracts even a chord corresponding to the determined non-functional chord progression technique, as a chord candidate.

6. The chord detection apparatus according to claim 1, wherein said tonality information acquisition unit includes a performance operating unit for inputting the performance data according to a user's performance operation.

7. The chord detection apparatus according to claim 1, wherein the chord detection timing is set in terms of at least one predetermined position or at least one beat position in each bar in the performance data.

8. The chord detection apparatus according to claim 1, wherein said selection unit selects the chord from the chord candidates extracted based on performance data acquired within a chord detection time period as the chord detection timing.

9. The chord detection apparatus according to claim 1, wherein said extraction unit extracts chord candidates represented by degree names, and develops the extracted chord candidates into chord names based on a current tonality.

10. The chord detection apparatus according to claim 1, wherein said extraction unit extracts the chord candidates that follow the reference chord according to whether a current tonality is a major tonality or a minor tonality.

11. The chord detection apparatus according to claim 5, wherein the non-functional chord progress technique includes cliche, passing diminish, and parallel motion.

12. The chord detection apparatus according to claim 2, wherein the tonality information detected each time the chord is selected by said selection unit is stored into said storage unit so as to be associated with the selected chord.

13. The chord detection apparatus according to claim 12, wherein information representing a function of the chord selected by said selection unit is stored into said storage unit.

14. The chord detection apparatus according to claim 1, wherein the reference chord referred to by said reference unit when a first chord is detected is a tonic chord.

15. The chord detection apparatus according to claim 1, wherein the selected chord is used for automatic accompaniment or used for generation of harmony tones.

16. The chord detection apparatus according to claim 1, wherein types of chords usable as the chord candidates is settable by a user.

17. The chord detection apparatus according to claim 1, wherein the predetermined timing range is zero.

18. The chord detection apparatus according to claim 1, wherein the predetermined timing range includes a timing that encompasses ahead of the chord-detection reference position and a timing that encompasses beyond the chord-detection reference position.

19. A chord detection method comprising:

a performance data acquisition step of acquiring performance data according to a user's performance operation;

a tonality information acquisition step of acquiring tonality information in the performance data;

a chord-detecting timing setting step of setting a chord-detection reference position and a chord-detection timing falling within a predetermined timing range about the chord-detection reference position;

an instruction step of detecting the chord detection timing and giving an instruction for chord detection;

a reference step of referring to a reference chord;

an extraction step of extracting, according to the tonality information acquired in said tonality information acquisition step, chord candidates that follow the reference chord referred to in said reference step; and a selection step of selecting a chord from the chord candidates extracted in said extraction step according to the performance data acquired in said performance data acquisition step when the instruction for chord detection is given in said instruction step.

20. A non-transitory computer-readable storage medium storing a computer program executable by a computer to execute a chord detection method comprising:

a performance data acquisition step of acquiring performance data according to a user's performance operation;

a tonality information acquisition step of acquiring tonality information in the performance data;

a chord-detecting timing setting step of setting a chord-detection reference position and a chord-detection timing falling within a predetermined timing range about the chord-detection reference position;

an instruction step of detecting the chord detection timing and giving an instruction for chord detection;

a reference step of referring to a reference chord;

an extraction step of extracting, according to the tonality information acquired in said tonality information acquisition step, chord candidates that follow the reference chord referred to in said reference step; and a selection step of selecting a chord from the chord candidates extracted in said extraction step according to the performance data acquired in said performance data acquisition step when the instruction for chord detection is given in said instruction step.

* * * * *